United States Patent [19]

Hance et al.

[11] 4,180,606

[45] Dec. 25, 1979

[54] FABRICS HAVING FLOCKED CORDUROY RIBS

[75] Inventors: Charles M. Hance, Woodruff; Charles D. Martin, Greer, both of S.C.

[73] Assignee: M. Lowenstein & Sons, Inc., New York, N.Y.

[21] Appl. No.: 818,457

[22] Filed: Jul. 25, 1977

[51] Int. Cl.[2] ..... B32B 33/00

[52] U.S. Cl. ..... 428/88; 118/200; 118/211; 118/239; 427/198; 427/200; 427/256; 427/271; 427/277; 427/286; 428/89; 428/90; 428/95; 428/167; 428/195; 428/196; 428/197

[58] Field of Search ..... 428/88, 89, 90, 95, 428/167, 195, 196, 197; 118/200, 211, 239; 427/198, 200, 256, 271, 277, 286

[56] References Cited

U.S. PATENT DOCUMENTS 3,979,538 9/1976 Gilman ..... 428/90

FOREIGN PATENT DOCUMENTS 2030867 1/1969 France ..... 428/90

*Primary Examiner*—Marion E. McCamish

*Attorney, Agent, or Firm*—Luke J. Wilburn, Jr.; Wellington M. Manning, Jr.

[57] ABSTRACT

Flocked fabric products having a woven corduroy appearance, including method and apparatus for producing such fabrics wherein an indefinite length substrate sheet is transported in a generally horizontal path of travel through a coating apparatus where a mass of viscous adhesive material is applied to the upper surface of the sheet while support means located beneath the sheet prevent displacement of the sheet from its path of travel and provide dimensional stability thereto. Immediately downstream of the support means the upper surface of the sheet and the adhesive material thereon is contacted by the notched edge of a knife blade to dispose the adhesive mass in a plurality of parallel upstanding ribs having upwardly tapered sides in transverse cross-section. The blade notches are of generally trapezoidal shape with side edges tapering inwardly from the bottom edge of the blade, and means are provided for adjusting the effective heights of the notches to control the height of the ribs applied to the substrate sheet. The adhesive-ribbed sheet is subsequently flocked, heated, brushed and vacuumed to provide a flocked fabric having the appearance of woven corduroy.

17 Claims, 4 Drawing Figures

FABRICS HAVING FLOCKED CORDUROY RIBS

The present invention is directed to the production of flocked fabrics, and, more particularly, to flocked fabrics having the unique visual appearance of woven corduroy. The invention is also directed to method and apparatus for producing such flocked fabrics.

Corduroy fabrics are widely employed in production of various consumer products, such as wearing apparel and home furnishings, e.g., upholstery, draperies, and the like. Such corduroy fabrics have for years been conventionally produced in a weaving operation, wherein a relatively heavy woven cotton fabric, after weaving, is subjected to a subsequent surface-shearing operation to provide distinct surface ribs, or wales, in the fabric which create the visual appearance identified as corduroy. The particular wale construction and weight of the woven corduroy may be varied, depending upon the particular aesthetic appearance required in the fabric product.

The present invention is directed to the production of flocked fabrics having the appearance of woven corduroy, and to the particular method and apparatus for producing such flocked fabrics. The fabrics of the present invention exhibit an excellent woven corduroy appearance, are more commercially economical to produce than conventional woven corduroy, and possess abrasion resistance believed far superior to that of the woven cotton corduroy fabrics of the prior art.

More particularly, the fabrics of the present invention are produced by application of discrete, parallel, raised ribs of viscous adhesive material onto the surface of a textile substrate, such as a woven fabric sheet, by first applying a mass of adhesive material to the upper surface of the moving sheet, and thereafter contacting the adhesive-coated surface with a serrated knife blade under controlled fabric tension to create plural discrete, spaced rows of parallel raised ribs of adhesive on the fabric surface. The sheet is thereafter flocked, in conventional manner, with precision cut textile fibers, dried to solidify the adhesive and bind the fibers to the sheet, and finished by brushing and vacuuming. The resultant product exhibits a remarkably similar appearance to conventional woven corduroy, and possesses exceptional abrasion resistance and breathability.

The fabrics of the present invention possess the unique visual appearance of woven corduroy due to the fact that the raised flocked ribs, or wales, on the surface of the fabrics are formed by uniquely shaping the adhesive in forming the ribs. In particular, each of the flocked ribs of the fabric, when viewed in transverse vertical cross section, have upwardly and inwardly sloping side surfaces, and the flock fibers are disposed in closely spaced relation over the entire surface of the ribs, extending outwardly therefrom generally perpendicular to the surface portion of the rib in which they are embedded. The surface of the substrate sheet between the adhesive ribs is substantially free of adhesive such that the spaces, or "valleys", between the ribs remain substantially free of flocked fibers to provide the corduroy wale appearance.

Although it has been known to produce patterned flocked fabrics by applying adhesive material to selected surface portions of a fabric substrate and thereafter flocking the same, such patterned adhesive applications have, as far as known, been accomplished only by use of transfer rolls, stencils, or the like. From our knowledge and experience, we have not found it possible to produce the particular shaped ribs of adhesive which are required to provide the corduroy appearance of the present invention by the use of transfer rolls, stencils, or the like. However, we have discovered that rib shapes can be obtained on the surface of a fabric substrate by the unique construction and arrangement of coating apparatus as hereinafter described, under controlled fabric tension, to obtain the precise form, shape and pattern necessary to produce the woven corduroy appearance desired.

The flocked fabrics of the present invention may be produced either in the greige state for subsequent dyeing and finishing, or the substrate sheet and the flock fibers may be predyed and combined in the flocking operation to produce the finished product.

Materials which may be employed as substrates in the present invention include any textile materials, fibers, and yarns which may be formed into sheet form, e.g., woven, nonwoven, knitted, and which, in sheet form, possess sufficient dimensional stability to preclude appreciable extension when under tension. Particularly desirable results in simulation of a woven corduroy fabric have been obtained by the use of woven fabrics composed of 100% polyester, polyester/cotton blends, or 100% rayon fibers and yarns. The exact construction and weight of the substrate sheet may be varied, depending upon the particular characteristics desired in the fabric product. For example, in wearing apparel fabrics, such as outerwear, a lighter weight substrate material may be preferred, whereas, in home furnishings fabrics, such as draperies, upholstery, and the like, a heavier weight substrate may be preferred.

The fibers which may be employed in the flocking operation may also vary depending upon the desired characteristics of the fabric product. Typically, conventional fibers such as nylon, rayon, polyester, and acrylic fibers of flock length, e.g., up to about 1/10 of an inch in length, may be utilized. For improved abrasion resistance with excellent corduroy appearance, nylon flocked fibers are preferred.

Various polymeric materials may be utilized to adhesively bind the flocked fibers to the fabric substrate, and many such adhesive compositions are commercially available and well known in the flocking art. Typically, the adhesive composition may comprise an acrylic latex, or a urethane polymer emulsion. Vinyl polymers are also well known and commercially available for this purpose. For safety and ease of commercial manufacture, water-based acrylic latexes are preferred as the adhesive material. The viscosity of the adhesive material may be varied, depending upon the requirements of the construction of the fabric product, and generally, acrylic latexes having a viscosity of between about 50,000 to 150,000 have been found to be preferred for the corduroy fabrics of the present invention. The adhesive composition may be pre-tinted to conform to the desired colors of the final products, if desired.

Details of the apparatus and process of the present invention will best be described and understood from the following detailed description of the apparatus of the invention, when taken together with the accompanying drawings, in which.

Figure 1:
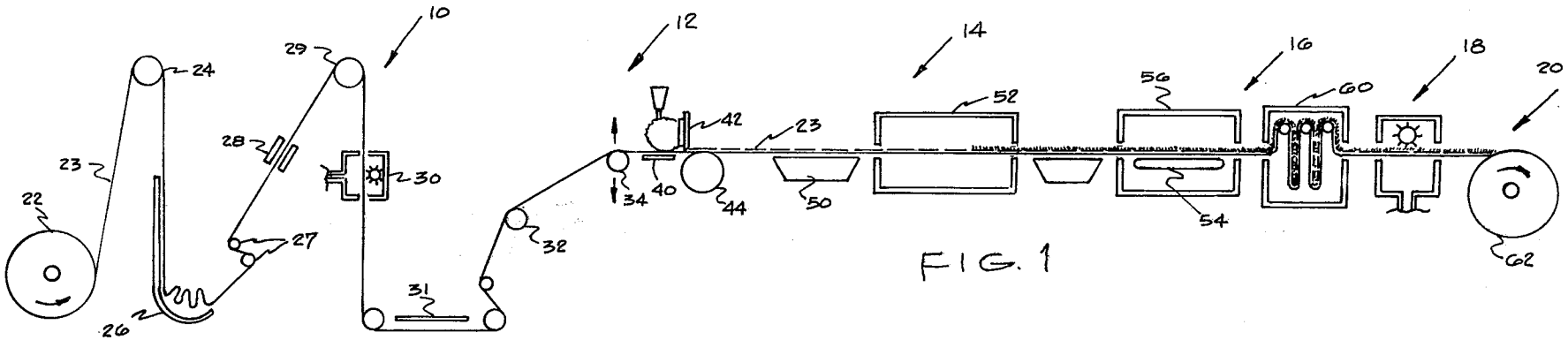
FIG. 1 is a schematic, side elevation view of apparatus for producing flocked corduroy fabrics in accordance with the present invention.

Referring more particularly to the drawings, FIG. 1 shows production range apparatus for manufacture of flocked corduroy fabrics of the present invention. As seen, the range includes a fabric supply section 10, a coating section 12, a flocking section 14, a heating and drying section 16, a final brushing and vacuuming section 18, and a fabric take-up section 20.

Fabric section 10 comprises a supply roll 22 from which an indefinite length, continuous sheet of substrate material, such as a woven fabric 23, is delivered, by means of a driven roller 24, into a fabric accumulation device, such as a scray 26, which is well known in the art. Scray 26 permits accumulation and storage of the fabric so that downstream operations of the range may be continuously operated while permitting intermittent replacement of fabric rolls at the supply roll position 22. From scray 26 the woven fabric substrate is directed upwardly over tensioning rods 27, edge guide means 28 to a guide roller 29, from which it passes downwardly through a brushing and vacuum device 30 to remove foreign impurities from the fabric. The fabric then passes beneath an operator's platform 31 and upwardly to the front of the coating section 12. To orient, spread, and properly align the fabric for full open-width passage through the coating section under proper tension, a conventional bow roll 32 and an adjustable spreader roll 34 are provided in the path of the travel of the fabric to coating section 12. Since fabric tensioning rods, edge-guiding devices, bow rolls, and spreader rolls are well known in the textile art, they will not be described in detail herein.

In coating section 12, a plurality of discrete, parallel, raised ribs of adhesive material are applied to the upper surface of the fabric substrate by a unique arrangement of a fabric support table, or plate 40, coating knife 42, and driven support roller 44. The construction and arrangement of the apparatus of coating section 12 will be described with particularity hereinafter in reference to FIGS. 2 and 3.

The adhesively ribbed fabric 23 leaving coating section 12 passes generally horizontally over a vacuum guide box 50 and into a conventional flocking module 52 where flock fibers of desired length are introduced into and adhesively attached to the adhesive ribs on the surface of the substrate sheet. Typically, the flocking module is of conventional construction and may comprise an electrostatic and/or beater bar type module well known in the flocking art.

The flocked fabric leaving flocking module 52 passes in generally horizontal direction onto pins of a pin tenter frame 54 which transports the flocked fabric in dimensionally fixed configuration through a forced hot air heating section 56 to initially dry the adhesive ribs. The fabric leaving the tenter frame is thereafter passed through a conventional loop dryer 60 where the adhesive is solidified to bind the flocked fibers to the woven substrate.

The flocked fabric leaving the loop dryer is brushed and vacuumed in conventional manner in section 18 and thereafter collected on a roll 62.

The coating section 12 of the range of the present invention is best shown and described in detail by reference to FIG. 2, which is an enlarged side elevation view of coating section 12 of the range. The fabric substrate passing from beneath the operator's platform 31 over bow roll 32 is directed onto the upper surface of support table or plate 40 by means of spreader roll 34 which may be adjustably positioned in a vertical direction to control the angle at which the fabric is introduced onto support plate 40. The position of roll 34 further facilitates the obtaining of a desired tension on the fabric substrate to ensure that it passes through the coating section in a substantially dimensionally fixed configuration.

Figure 3:
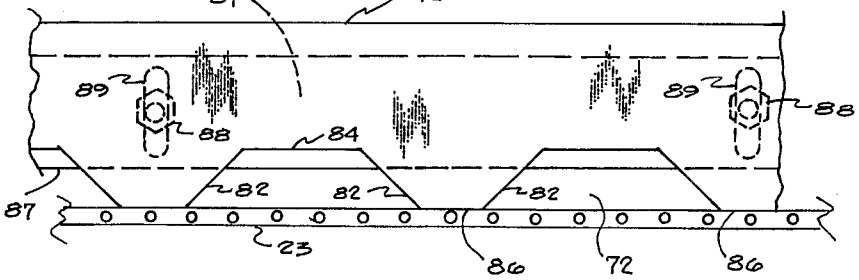
FIG. 3 is an enlarged front elevation view of a broken away portion of a coating knife employed in the coating section of the apparatus of the present invention.

Positioned immediately downstream of support plate 40 and above the horizontal path of movement of the fabric is vertically disposed knife 42 which extends across the width of the fabric and is provided with a plurality of serrations or notches 72 in its lower edge which contacts the upper surface of the fabric (FIG. 3). Positioned above the support table 40 are suitable adhesive supply means, such as a moving supply nozzle 74, which directs a supply of viscous adhesive material, such as an acrylic latex, onto the upper surface of fabric 23. The adhesive material may be supplied under positive pump pressure, or by gravity, from a suitable supply source, not shown. As the coating material falls onto the upper surface of the moving fabric, it forms an elongate roll or mass 76 which is contained on the upper surface of the fabric against the upstream face of coating blade 42 by suitable side plates, or dams, (not shown) which are located at the ends of blade 42 and angle inwardly in the direction of movement of the fabric.

Figure 2:
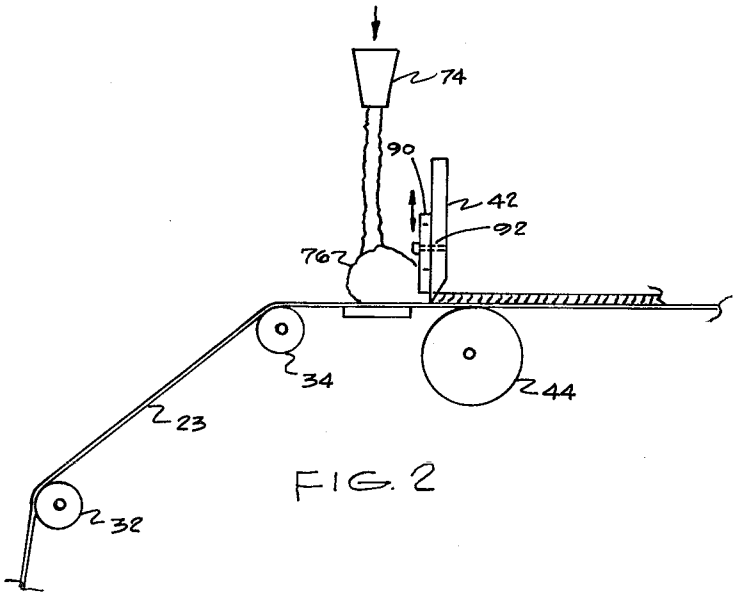
FIG. 2 is an enlarged, schematic side elevation view of the coating section of the apparatus shown in FIG. 1.

As seen in FIG. 2, support plate 40 beneath the path of travel of the substrate fabric is spaced immediately upstream of blade 42 in such a manner that it supports the weight of the adhesive mass 76 and the fabric to prevent any displacement or sagging of the fabric from its generally horizontal path of travel beneath the knife. The lower edge of the blade thus contacts the upper surface of the fabric in a "floating" arrangement, i.e., the fabric immediately beneath the contacting edge of the blade is maintained free from contact by any supporting means, to facilitate an even, uniform distribution of adhesive in plural raised parallel ribs across the width of the fabric. The floating arrangement of the blade 42 also prevents possible damage to the fabric and/or necessity for stopping the range due to passage of fabric seams through the coating section.

Immediately downstream of blade 42 is driven support roller 44 which further maintains the path of the fabric such that it at all times is contacted by the bottom edge of the blade during the rib-building operation.

The construction of the lower edge of the coating blade 42 of the present invention is best shown and described by reference to FIG. 3, which is a right side, elevation view of a broken away portion of the blade as seen in FIG. 2. As shown, the lower edge of the knife which contacts the upper surface of the moving fabric 23 is provided with a plurality of notches 72 having upwardly tapering side edges 82 and a horizontal top edge 84. The horizontal edge portions 86 of the lower edge of the blade are maintained in contact with the fabric.

The angles of the side edges 82 of notches 72 are selected such that the upstanding ribs of adhesive which are formed on the upper surface of the fabric correspondingly taper inwardly from their bases. In this manner, the raised ribs of adhesive on the fabric leaving the coating section are self-supporting and maintain their general shape and raised configuration during the subsequent flocking operation on the coating range. Although the angle of the taper of the side edges of the notches of the blade may vary to some extent, it has been found that blades with notches having side edges cut at an angle of approximately 45° to the bottom edge of the blade and the upper surface of the fabric provide excellent shape retention of the ribs during flocking to produce the appearance of woven corduroy in the final fabric product.

In producing flocked fabrics having a woven corduroy appearance, it is desired that the lower edge of blade 42 at all times contact the upper surface of the fabric substrate to effectively remove substantially all adhesive from the surface of the fabric between the ribs. Thus, in the subsequent flocking operation, the fabric surface spaces between the ribs will be substantially free of adhesively bound flocked fibers. By maintaining the surface of the fabric substantially free of adhesive between the ribs, the fabric product not only possesses an excellent corduroy appearance, but is maintained porous for better breathability during use.

As seen in FIG. 3, the height of the adhesive ribs which are applied to the fabric may be regulated by means of a vertically adjustable bar 87 attached to the upstream face of blade 42 by suitable fastening means, such as bolts 88 positioned in spaced vertical slots 89 of the bar. The slots and bolts may be spaced along the entire length of the bar and blade to permit accurate and uniform adjustment of the bar 87 by micrometer.

Thus, by maintaining the serrated blade 42 in a "floating" relationship with the horizontally moving fabric, and by providing support means directly before and after the blade to support the adhesive mass and effectively guide the fabric beneath the knife blade, ribs of adhesive are uniformly applied to the fabric and maintained in their upstanding configuration through the flocking section of the range. Due to the upstanding configuration of the adhesive ribs, and the ability to maintain them in this configuration during flocking, flocked fibers are uniformly embedded in the ribs over their entire surface area. Further, by maintaining the surface of the fabric between the ribs substantially free of adhesive, the valleys between the ribs are maintained free of flocked fibers.

It can be appreciated that the width of the ribs of adhesive applied to the fabric substrate, their density, or spacing, across the fabric, and the distance between the ribs may be varied by providing several coating blades of varying notch size and frequency.

It has been found that excellent woven corduroy appearance in the flocked fabrics of the present invention can be obtained by use of a notched coating blade having trapezoidal shaped notches, as shown in FIG. 3, with side edges of the notches tapered upwardly and inwardly at an angle of approximately 45° to the lower edge of the blade, and with a notch top edge width of from about 0.015" to 0.030", a notch base spacing of about 0.015" to 0.030", and a notch height of up to 0.030". The denier of the flock fibers may vary from about 1 to 5, and fiber lengths of from about 0.025" to 0.10" are preferred.

Due to removal of liquid from the adhesive coating composition during drying and solidifying of the adhesive ribs in heating section 16 of the range, it can be appreciated that the exact cross-sectional dimensions and size of the adhesive ribs in the final product will vary slightly from those formed at the coating blade. Generally, the flocked ribs of the final corduroy fabric product are slightly smaller and somewhat more rounded in cross-sectional configuration than as appears after flocking and before drying. Therefore, the height of the notches of the coating blade 42 may be readily adjusted, accordingly, to produce the particular flocked rib height desired in the final product.

As shown in FIG. 2, the downstream lower edge of blade 42 may be beveled from the plane of its lower edge to facilitate uniform shaping of the ribs of adhesive material passing through the notches of the blade.

Figure 4:
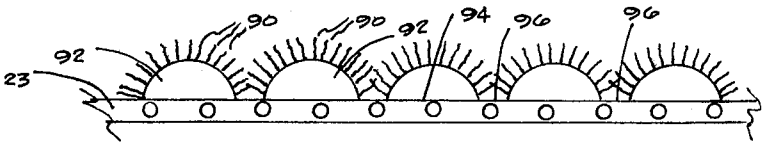
FIG. 4 is a vertical, transverse sectional view, in schematic presentation, showing the construction of a flocked corduroy fabric produced in accordance with the method and apparatus of the present invention.

The general construction and configuration of the final flocked fabric product is best illustrated by reference to FIG. 4 which is a schematic vertical cross-sectional view of a typical fabric produced in accordance with the present invention. As seen in FIG. 4, the flocked fibers 90 of the fabric are securely embedded in spaced parallel rows of upstanding ribs 92 of adhesive, with side edges of the adhesive rib sloping inwardly and upwardly from a larger base portion 94 of the rib. The flocked fibers extend outwardly and are generally perpendicular, or at right angles, to the surface portion of the rib to which their base tips are embedded. They are generally evenly distributed throughout the total exposed surface of the ribs. The surfaces 96 of the base fabric 23 between the upstanding ribs 92 are substantially free of adhesive and flocked fibers to provide excellent breathability for the fabric product.

For purposes of illustration, the following specific example of a method and materials employed on the range illustrated in FIG. 1 to produce a commercially attractive and acceptable flocked corduroy fabric is given. Unless otherwise indicated, percentages are by weight in the example.

EXAMPLE

A length of 100% rayon woven fabric 57 inches in width and having a pick count of 68×38 and a fabric weight of 5.82 ounces per square yard was scoured, singed, and dyed to a preselected color. The fabric was continuously delivered by way of the fabric supply section 10 of FIG. 1 to the coating section 12 of the range.

The fabric, in open width configuration and under longitudinal tension, was directed across support plate 40 and beneath the coating blade 42 as an adhesive composition comprising a 50% solids aqueous acrylic emulsion (C. L. Hauthaway, 185/160 acrylic emulsion) having a viscosity of 160,000 centipoise was continuously supplied to maintain a viscous mass of the adhesive composition on the top surface of the fabric above plate 40.

The lower edge of the coating coating blade contained uniformly spaced notches having a notch base width of 0.20 inches and a notch to notch separation of 0.03 inches. The adjustable bar 87 of the blade was set to provide a notch height of 0.018 inches. Passage of the fabric beneath the knife blade produced upstanding parallel adhesive ribs at a spaced uniform distribution across the fabric.

The adhesively ribbed fabric passed by way of driven roller 44 and vacuum guide box 50 into the flocking section of the range where the fabric was uniformly flocked in conventional manner with predyed nylon fibers of 3 denier having a fiber length of 0.07 inches. The flocking section of the range was comprised of two standard Indev Corporation triple module, 3 feed, AC electrostatic beater bar flock modules.

The flocked fabric thereafter passed by the pin tenter frame through the tenter heating oven where the fabric was heated to a 235° F. temperature to dry the adhesive. The fabric thereafter passed through the loop dryer for a 15 minute dwell time at a fabric temperature of 300° F. to solidify the adhesive and bind the flock fibers to the fabric substrate. The fabric was brushed and vacuumed and collected on a roll.

The resultant fabric, having a 10 ounce per square yard weight and a flock rib density of 5 wales per inch, exhibited an excellent woven corduroy appearance.

Abrasion resistance of the thus produced fabric was compared to the abrasion resistance of a conventional woven cotton corduroy fabric, as follows;

Two samples of the flocked corduroy fabric, produced as above, were compared with two samples of a woven cotton corduroy fabric having a fabric weight of 9.6 ounces per square yard and a rib density of 5 ribs, or wales, per inch. The pile fastness of the samples were compared by the standard Inflated Diaphram Method ASTM D-1175, modified. After 200 cycles, the average fabric weight loss of the two flocked corduroy fabric samples was 0%, while the average fabric weight loss of the two woven cotton corduroy samples was 0.6%.

Two additional samples each of the flocked and woven corduroy fabrics identified above were further tested for frosting abrasion by ASTM Wire Screen Test Method D-2814. On a classification scale of 1 to 5, with 5 being the best in abrasion resistance, the average classification of the woven corduroy samples was 1.5, while the average of the flocked corduroy samples was 4.0.

That which is claimed is:

1. Apparatus for producing flocked fabrics having a woven corduroy appearance comprising means for longitudinally moving an indefinite length sheet of material in a generally horizontal path of travel while maintaining the sheet in an open-width, generally dimensionally fixed configuration, means located at a first position along said path for providing a viscous mass of adhesive material on the upper surface of the moving sheet, support means positioned below the sheet at said first position for contacting the under side of the moving sheet to support the sheet and mass of adhesive material thereon to prevent any appreciable displacement of the sheet from the path, means located at a second position immediately downstream of said first position and spaced from said support means along said path contacting the upper surface of the sheet and the adhesive mass thereon to dispose the adhesive material on the upper surface of the sheet into a plurality of upstanding spaced, parallel ribs of adhesive extending in the direction of movement of the sheet while removing substantially all adhesive from the upper surface areas of the sheet between the ribs, flocking means located at a third position along said path downstream of said second position for embedding a plurality of flock fibers into the surface of the upstanding adhesive ribs, with the fibers located in closely spaced relation and extending outwardly from the exposed surface of the ribs generally perpendicular to the surface portions of the ribs in which they are embedded, means for heating the thus flocked sheet to dry and solidify the adhesive ribs and bond the fibers to the moving sheet, and means for collecting the flocked fabric sheet after drying.

2. Apparatus as defined in claim 1 wherein said means for contacting the upper surface of the sheet and adhesive mass thereon comprises an elongate blade disposed above and extending transversely across the path of travel of the sheet, the lower edge of said blade positioned for engagement with the upper surface of the sheet during its movement along said path of travel and having a plurality of notches disposed along said edge, each of said notches being of generally trapezoidal shape and having inwardly and upwardly tapering side edges to dispose the adhesive material on the upper surface of the sheet in the plurality of discrete upstanding spaced parallel ribs during passage of the sheet beneath the blade.

3. Apparatus as defined in claim 2 including bar means attached to and extending along said blade, said bar means including means for adjustably vertically positioning the bar means in overlying relation with said notches to vary the effective heights thereof and thus control the height of the ribs of adhesive applied to the upper surface of the sheet during its passage beneath the blade.

4. Apparatus as defined in claim 3 wherein the effective height of each of said notches is from about 0.015 to 0.030 inches.

5. Apparatus as defined in claim 2 wherein the tapering side edges of each of said notches defines an angle of approximately 45° with the bottom edge of said blade.

6. Apparatus as defined in claim 2 wherein the closest distance between immediately adjacent side edges of said notches along said bar is from about 0.015 to 0.030 inches.

7. Apparatus as defined in claim 2 wherein said means positioned below said sheet at said first position for contacting the under side of the moving sheet comprises plate means extending across the path of movement of the sheet, the downstream edge of said plate means being spaced upstream from said blade in the path of movement of the sheet whereby the sheet is free from contact by support means beneath the blade.

8. Apparatus as defined in claim 7 including adjustable means immediately upstream of said plate for supportably guiding the moving sheet into engagement with the plate to facilitate control of longitudinal tension of the sheet during its movement beneath the blade.

9. A method of producing a flocked textile product having the appearance of woven corduroy comprising the steps of:

(a) passing an indefinite length sheet of textile material in a generally horizontal path while under tension to maintain it dimensionally stable;

(b) applying a viscous mass of adhesive material to the upper surface of the sheet at a first position along said path while contacting the undersurface of said sheet at said position with support means to prevent any appreciable displacement of the sheet from the path due to weight of the adhesive mass;

(c) thereafter contacting the upper surface of said sheet with the notched edge of a knife blade at a second position along said path in which the undersurface of the sheet is unsupported to dispose the adhesive in a plurality of closely spaced upwardly tapering ribs of adhesive;

(d) flocking said sheet containing the adhesive ribs with fibers to embed end portions of the fibers in the adhesive ribs with the fibers in closely spaced relation and extending outwardly from the surface portions of the ribs at a generally right angle thereto; and (e) drying and solidifying the adhesive to firmly secure the embedded fibers to the substrate sheet to produce a flocked product having the appearance of woven corduroy.

10. A textile fabric comprising a flexible substrate sheet, a plurality of substantially parallel, closely spaced, raised ribs of adhesive material extending along and secured to one surface of said sheet, each of said ribs being defined in transverse cross-section by opposed side surfaces sloping upwardly and inwardly from said sheet surface to the top of the rib, and a plurality of closely spaced, discrete fibers of predetermined length adhesively embedded in and extending outwardly from the overall exposed surface of each of said ribs of adhesive, with surface portions of said sheet between said ribs of adhesive being substantially free of adhesive and said fibers to provide an appearance in said fabric substantially similar to woven corduroy.

11. A textile fabric as defined in claim 10 wherein the height of each of said ribs of adhesive on said sheet is from about 0.015 to 0.030 inches.

12. A textile fabric as defined in claim 11 wherein the closest distance between immediately adajacent side surfaces of adjacent ribs of adhesive on said sheet is from about 0.015 to 0.030 inches.

13. A textile fabric as defined in claim 10 wherein said fibers extend substantially perpendicular to the surface portions of said ribs in which they are embedded.

14. A textile fabric as defined in claim 13 wherein the length of said fibers is from about 0.025 to 0.10 inch and their denier is from about 1 to 5.

15. A textile fabric as defined in claim 10 wherein said sheet is a woven fabric and said fibers are nylon.

16. A textile fabric as defined in claim 15 wherein said ribs of adhesive are comprised of an acrylic resin.

17. A textile fabric as defined in claim 10 wherein said sheet contains from about 5 to 14 ribs of adhesive per inch.

* * * * *

Disclaimer and Dedication 4,180,606.—*Charles M. Hance,* Woodruff and *Charles D. Martin,* Greer, S.C. FABRICS HAVING FLOCKED CORDUROY RIBS. Patent dated Dec. 25, 1979. Disclaimer and Dedication filed July 2, 1981, by the assignee, *M. Lowenstein Corp.*

Hereby disclaims and dedicates to the Public the entire remaining term of said patent.

[*Official Gazette August 22, 1981.*]